350-357 SR
5/7/85 XR 4,516,120

United States Patent [19]

Sakuyama

[11] Patent Number: 4,516,120

[45] Date of Patent: May 7, 1985

[54] DISPLAY DEVICE

[75] Inventor: Masao Sakuyama, Tanashi, Japan

[73] Assignee: Citizen Watch Company Limited, Tokyo, Japan

[21] Appl. No.: 337,224

[22] Filed: Jan. 6, 1982

[30] Foreign Application Priority Data

Jan. 12, 1981 [JP] Japan ..... 56-2885
Feb. 24, 1981 [JP] Japan ..... 56-25732

[51] Int. Cl.[3] ..... G09G 3/34

[52] U.S. Cl. ..... 340/785; 340/811; 350/357

[58] Field of Search ..... 340/785, 811; 350/357

[56] References Cited

U.S. PATENT DOCUMENTS 4,123,671 10/1978 Aihara et al. ..... 340/811 X 4,210,909 7/1980 Hamada et al. ..... 340/785 X

*Primary Examiner*—David L. Trafton
*Attorney, Agent, or Firm*—Jordan and Hamburg

[57] ABSTRACT

A display device incorporating an electrochromic display cell is provided with means whereby each segment electrode of the electrochromic display cell can be set into a completely electrically isolated state after a condition of coloration of a corresponding display element has been established. Since no leakage current is permitted to flow between the segment electrode and the drive transistors coupled thereto, a charge is stored on the segment electrode which maintains the coloration condition over a considerably longer period of time than has been possible hitherto, thus enabling an electrochromic display device to be realized having a very low level of power consumption.

7 Claims, 23 Drawing Figures

10
TIMEBASE OSCILLATION CIRCUIT
12
TIMING SIGNAL GENERATING CIRCUIT
d
a
TIME CORRECTION SECTION
16
b
c
18
20
VDD
VDD
56
VOLTAGE STEP-DOWN CIRCUIT
Vssi
e
f
58
PX
46
49
50
52A
48
54
52B
52N
COMMON ELECTRODE DRIVE CIRCUIT 44
Vssi
ELECTROCHROMIC DISPLAY CELL 52 t1 t2 t3 t4 t5 t6 t7 t8 t9 t10

| Fig. 4A | Fig. 4B |
|---|---|

| Fig. 8A | Fig. 8B |
|---|---|

| Fig. 9A | Fig. 9B |
|---|---|

DISPLAY DEVICE

BACKGROUND OF THE INVENTION

There is at present a widespread demand for display devices utilizing electrochromic display cells, for use in various types of electronic equipment. It has been difficult hitherto, however, to apply such electrochromic display cells to miniature electronic devices such as electronic wristwatches, because it has not been possible to ensure a sufficiently low level of power consumption. This is due to the fact that when a display segment has been set into a condition of coloration, by momentarily applying a potential between the corresponding segment electrode and the common electrode of the electrochromic display cell, thereby causing a current to momentarily flow between them, it has not been possible to ensure that the segment electrode is thereafter held in an electrically isolated condition with respect to the drive circuitry to which it is coupled. Thus, although no power is actually required in order to maintain the coloration condition of a segment once that condition has been established, since the charge developed on the capacitance between the segment electrode and the common electrode will act to maintain the coloration condition, in actual practice this charge is dissipated, in prior art electrochromic display devices, due to current leakage from the segment electrode after the coloration condition has been established.

With the present invention, such leakage of charge on the segment electrode is eliminated, thereby permitting a coloration condition of a display segment in an electrochromic display cell to be memorized over a long period of time without the necessity to supply power to the display cell in order to maintain the coloration condition. As a result, the power consumption of an electrochromic display device according to the present invention is substantially lower than that of prior art electrochromic display devices, making such a device suitable for use in miniature electronic devices such as electronic wristwatches.

SUMMARY OF THE INVENTION

A display device according to the present invention comprises an electrochromic display cell having a common electrode and a plurality of segment electrodes, timing signal generating means for producing a plurality of timing signals of different frequencies, a display data circuit for producing display data signals to designate information to be displayed, a drive control circuit responsive to the display data signals for producing bleaching drive and coloration drive signals, a segment electrode drive circuit for producing segment electrode drive signals in response to the bleaching drive and coloration drive signals, and a common electrode drive circuit for producing common electrode drive signals in response to the timing signals. In the segment electrode drive circuit, a bleaching drive transistor is set into the conducting state momentarily by the bleaching drive signal when the corresponding display segment is to be set in a bleached, i.e. non-colored condition, while a coloration drive transistor is set into the conducting state momentarily by the coloration drive signal when the coloration condition of the corresponding display segment is to be established. It is the important feature of novelty of the present invention that the control electrode of the coloration drive transistor (i.e. the base, in the case of a bipolar transistor and the gate in the case of an FET), is held connected to a voltage of such magnitude and polarity, after the coloration condition has been established, that the coloration drive transistor is fixedly maintained in the non-conducting state irrespective of changes in the potential of the corresponding segment electrode caused by the common electrode drive signal applied to the common electrode of the electrochromic display cell. Thus, the segment electrode is effectively held in an electrically isolated state, after the coloration condition has been established, in which no leakage current can flow between the segment electrode and the drive transistors. The coloration condition of a display segment is thereby "memorized" over a long period of time, without the need to supply power to maintain that condition.

DESCRIPTION OF THE PREFERRED EMBODIMENTS

Figures 1, 1A, 1B:
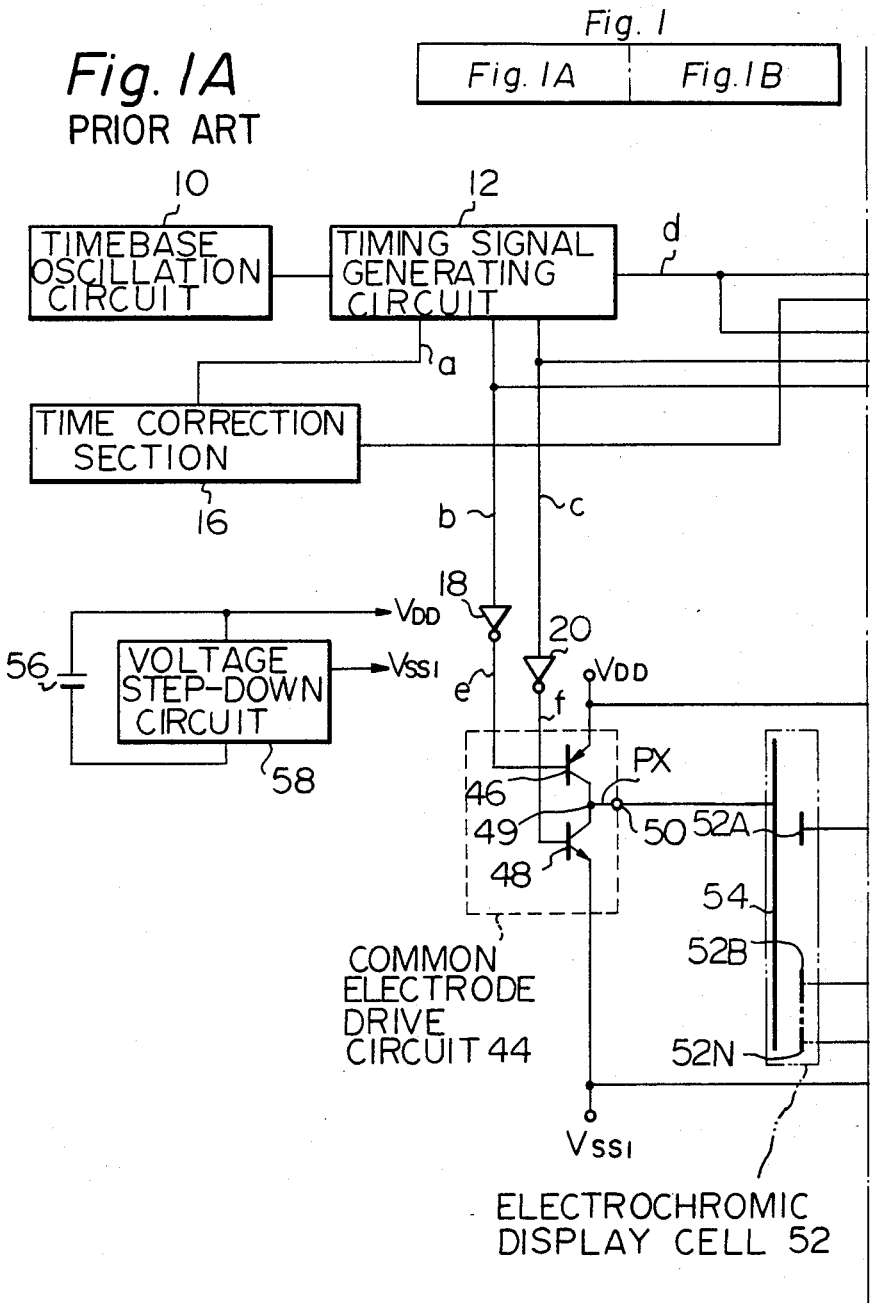
Fig. 1A PRIOR ART
FIG. 1 comprising FIGS. 1A and 1B constitute a block diagram of an embodiment of an electronic timepiece according to the prior art incorporating an electrochromic display cell, in which bipolar transistors are utilized in display drive circuits.
Figure 1B:
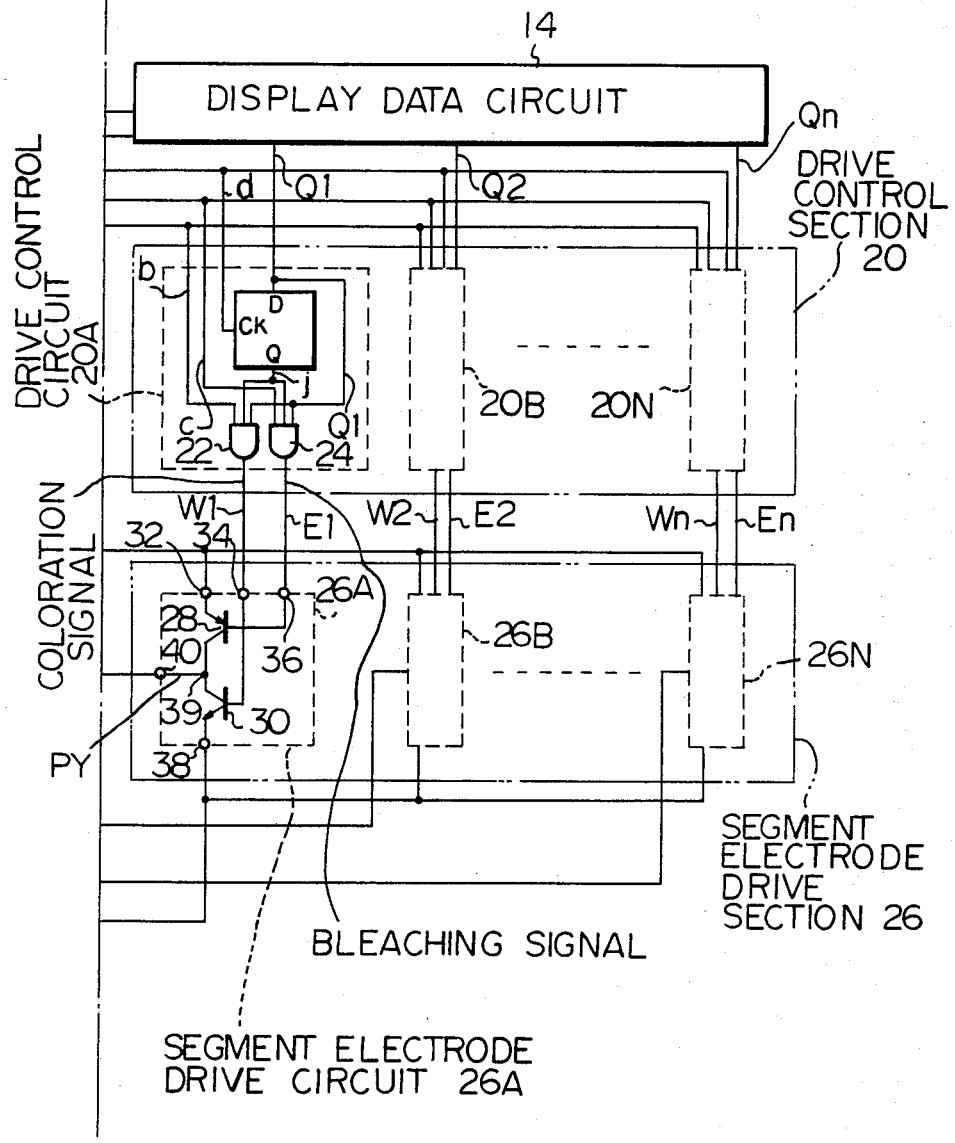
Fig. 1B PRIOR ART

A first embodiment of a display device according to the prior art will now be described, with reference to the block circuit diagram of FIGS. 1A and 1B and the timing diagram of FIGS. 2(A) to 2(I). The embodiment of FIGS. 1A and 1B, and also the embodiments of the present invention described hereinafter, comprises an electronic timepiece equipped with an electrochromic display. However it should be understood that the present invention is applicable to a wide variety of devices equipped with electrochromic display means, and is not limited to electronic timepiece applications. In FIGS. 1A, numeral 10 denotes a quartz crystal oscillator circuit for producing a standard timebase signal. This timebase signal is input to a timing signal generating circuit 12, which produces various timing signals comprising pulse trains of different frequencies generated by frequency division of the timebase signal from oscillator circuit 10, and designated by the letters a, b, c and d. Timing signal d is input to a data display circuit 14, which comprises counter circuits for counting timing signal d to produce current time information signals, indicative of seconds, minutes, hours, etc. The data display circuit 14 further comprises display decoder circuits, which are responsive to the time information signals for generating display drive input signals, denoted as Q1, Q2, . . . Qn in FIG. 1B. When any of these display drive input signals goes to a high logic level potential (abbreviated hereinafter to the "H level"), then this designates that one of a plurality of display segments of an electrochromic display cell 52 is to be set into a coloration condition as described hereinafter. Similarly, if any the display drive input signals Q1, Q2, . . . Qn goes to a low logic level potential (abbreviated hereinafter to the L level), then this designates that a corresponding one of the display segments of electrochromic display cell 52 is to be set into a bleached (i.e. non-colored) condition.

Numeral 16 denotes a time correction section, whereby the contents of data display circuit 14 can be altered by the user, through actuation of external operating means which are omitted from the drawings.

Display drive input signals Q1, Q2, . . . QN are input to corresponding drive control circuits 20A, 20B, . . . 20N, within a drive control section 20. Each of drive control circuits 20A, 20B, . . . 20N has the configuration shown for circuit 20A, comprising a data-type flip-flop 21, and AND gate 22 and an OR gate 24. Display drive input signal Q1 is applied to the data input terminal D of flip-flop 21A, and to one input of each of AND gate 22 and OR gate 24. The timing signal d is input to the clock terminal CK of flip-flop 21, while timing signal c is applied to an input of OR gate 24, and timing signal b is applied to an input of AND gate 22. An output signal j from output $\overline{Q}$ flip-flop 21 is applied to each of the remaining inputs of AND gate 22 and OR gate 24.

Output signals W1 and E1 from drive control circuit 20A are input to a segment electrode drive circuit 26A in a segment electrode drive section 26. Similarly, output signals W2, E2 from drive control circuit 20B, . . . output signals Wn, En from drive control circuit 20N are input to segment electrode drive circuit 26B, . . . segment electrode drive circuit 26N respectively, i.e. corresponding segment electrode drive circuits within segment electrode drive section 26. Each of segment electrode drive circuits 26A, 26B, . . . 26N has the circuit configuration shown for segment electrode drive circuit 26A. This comprises a pair of bipolar transistors, i.e. a PNP bleaching drive transistor 28 and a coloration drive NPN transistor 30, having their collectors coupled together to a terminal 40. The base electrode of PNP transistor 28 is coupled through a terminal 36 to receive output signal E1 from drive control circuit 20A, while the base of NPN transistor 30 is coupled through a terminal 34 to receive output signal W1 from drive control circuit 20A.

Numeral 56 denotes a battery 56, which constitutes the timepiece power source, and provides a positive supply potential Vdd and negative supply potential Vss. In the present embodiment, the potential difference (Vdd−Vss) will be assumed to be 1.5 V, and potential Vdd will be treated as reference OV potential, i.e. potential Vss will be designated as −1.5 V. Numeral 58 denotes a voltage step-down circuit connected across battery 56, which produces a supply potential Vss1, such that the potential difference (Vdd−Vss1) is less than (Vdd−Vss). Vss1 will typically be −0.78 V.

The junction of NPN transistor 30 and PNP transistor 28 is coupled through terminal 40 to a segment electrode 52A of an electrochromic display cell 52, so that an output signal SA from segment electrode drive circuit 26A is applied to segment electrode 52A. Similarly, output signals SB, . . . SN from segment electrode drive circuits 26B, . . . 26N are applied to segment electrodes 52B, . . . 52N of electrochromic display cell 52.

Timing signals b and c from timing signal generating circuit 12 are inverted by inverters 18 and 20, and the inverted timing signals thus produced are designated as e and f. Numeral 44 denotes a common electrode drive circuit comprising a PNP transistor 46 and an NPN transistor 48, whose collectors are connected together to a terminal 50. The base of PNP transistor 46 is coupled to receive inverted timing signal e, while the base of NPN transistor 48 is coupled to receive the inverted timing signal f. The collector of NPN transistor 48 is connected to supply potential Vss1, while the collector of PNP transistor 46 is connected to the supply potential Vdd. The collectors of NPN transistor 48 and PNP transistor 46 are connected to a common electrode 54 of electrochromic display cell 52.

An electrochromic display cell such as that of the example of FIG. 1A exhibits the phenomenon of electrochromism, whereby when one of the segment electrodes is set at a potential difference with respect to the common electrode which exceeds a certain threshold potential, a portion of the electrochromic display cell corresponding to that segment electrode becomes colored, as a result of current flowing between the segment electrode and common electrode. This condition of coloration will be maintained, so long as no further flow of current occurs between that segment electrode and the common electrode, since an electric charge is stored in the capacitance developed between the common electrode and that segment electrode, whereby a potential difference acting to maintain the state of coloration is established between the segment and common electrodes. If any leakage current flows between the common and segment electrodes in this condition, then the state of coloration will gradually disappear, i.e. bleaching of the corresponding display area will occur. In order to establish the bleached state rapidly, a potential difference opposite to that which establishes the coloration state is applied between the segment and common electrodes, whereupon a momentary current flow occurs. With such an electrochromic display cell, power is ideally consumed only when a change is made between the coloration state and the bleached state. Thus, in order to minimize the power consumption of such a display cell, it is desirable to ensure that the state in which the coloration condition is maintained, i.e. in which the electrochromic display cell acts to "memorize" the coloration condition, is sustained for as long as possible. For this purpose, it is necesary to eliminate any leakage of the charge stored in the capacitance established between the segment electrode and common electrode, when a segment electrode is at a potential such that coloration of the corresponding display area occurs. The latter condition of a segment electrode will be referred to herein as the coloration memory condition. The opposite condition will be referred to as the bleached condition.

Figures 2A, 2B, 2C, 2D, 2E, 2F, 2G, 2H, 2I:
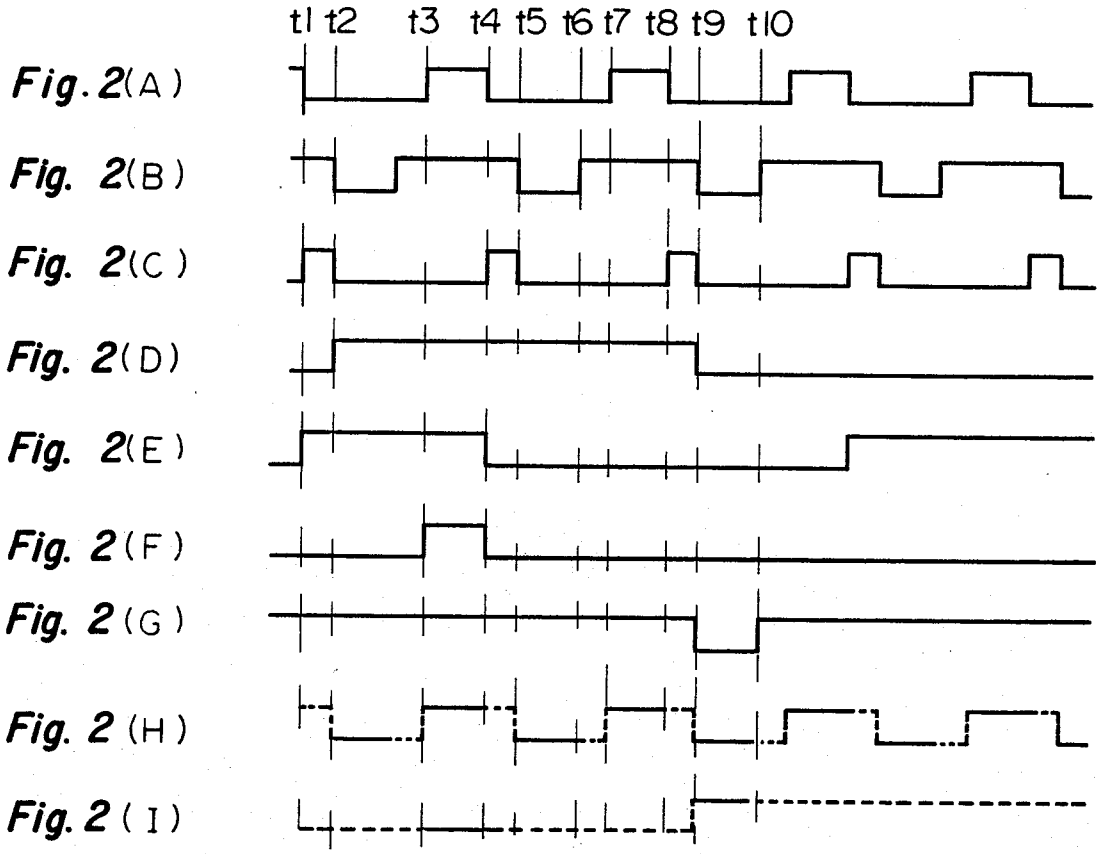
FIGS. 2(A) to 2(I) are timing diagrams for illustrating the operation of various display devices described herein.

The operation of the prior art display device shown in FIGS. 1A and 1B will now be discussed, with reference to FIGS. 2(A) to 2(I). Here, FIGS. 2(A) to 2(C) show the waveforms of timing signals b, c and d, FIG. 2(D) shows the waveform of output signal Q1 from data display circuit 14, FIG. 2(E) shows output signal j from flip-flop 21 of drive control circuit 20A, FIGS. 2(F) and 2(G) show coloration drive signal W1 and bleaching drive signal E1 from drive control circuit 20A, FIGS. 2(H) and 2(I) show the common electrode drive signal PX and segment electrode drive signal PY from common electrode drive circuit 44 and segment electrode drive circuit 26A respectively. In this embodiment, output signal Q1 changes logic levels only at the time of a falling edge of timing signal d, and data is read into flip-flop 21 on the leading edge of timing signal d. Thus, as shown in FIG. 2(E), signal j goes to the H level at time t1 since signal Q1 is then at the L level. Accordingly, at time t3, all of the inputs to AND gate 22 are at the H level, so that signal W1 goes to the H level. During the time interval from t1 to t9, signal Q1 remains at the H level, so that signal E1 from drive control circuit 20A also is held at the H level. PNP transistor 28 is therefore held in the non-conducting state (referred to herein as the OFF state) during the interval from t1 to t9. Thus, when signal W1 goes to the H level at time t3, NPN transistor 30 enters the conducting state (referred to herein as the ON state), so that segment electrode drive signal PY from segment electrode drive circuit 26A goes to the Vss1 level, as indicated by the first solid-line portion of FIG. 2(I). At other times, signal PY is in the floating, i.e. open-circuit condition, as indicated by the broken-line portions of FIG. 2(I). During the time interval from t3 to t4, timing signal b goes to the H level, so that inverse timing signal e goes to the L level, and hence PNP transistor 46 goes to the ON state. As a result, common electrode drive signal PX from common electrode drive circuit 44 does to the Vdd level during that interval, as indicated by the solid-line portion of FIG. 2(H). Thus, during the interval from t3 to t4, segment electrode 52A goes negative with respect to common electrode 54 by a potential Vss1. Segment 52A thereby enters the coloration condition.

Subsequently, from time t4 to t9, signal PY enters the floating condition, in which segment electrode 52A should ideally be in an electrically isolated state, so that a potential difference equal to Vss1 will be maintained between segment electrode 52A and common electrode 54. If this is the case, then the coloration condition of segment electrode 52A will be maintained until time t9.

At time t9, signal Q1 from data display circuit 14 goes to the L level, and as a result, output signal E1 from drive control circuit 20A goes to the L level from time t9 to t10. During this interval, output signal W1 from drive control circuit 20A is at the L level, so that NPN transistor 30 is held in the OFF state. Thus, the L level state of signal E1 results in PNP transistor 28 of segment electrode drive circuit 26A being set in the ON state so that drive signal PY goes to the Vdd level. In this case, a potential difference equal to Vss1 is established between segment electrode 52A and common electrode 54 of electrochromic display cell 52, but in the opposite direction to that established at time t3, i.e. segment electrode 52A is now at a positive potential with respect to common electrode 54. Current thereby flows through electrochromic display cell 52 such as to terminate the coloration condition of segment electrode 52A, i.e. the bleaching condition is established for that segment electrode. Thereafter, from time t10, segment electrode 52A should ideally become electrically isolated, with the floating condition of signal PY being re-established as indicated by the broken line portion. This bleached condition for segment electrode 52A will be maintained until the next time signal Q1 returns to the H level, when the coloration condition will be re-established.

With such a display device, drive signal PX applied to common electrode 54 of electrochromic display cell 52 alternates between the Vdd and Vss1 levels, as shown in FIG. 2(H). As a result, such a prior art display device possesses a serious disadvantage. That is, when common electrode drive signal PX returns from the Vdd level to the Vss1 level, e.g. at time t5, when the coloration memory condition has been established for a segment electrode such as 52A, then as a result of the capacitance between that segment electrode and the common electrode, the potential of the segment electrode will move, in the negative direction, by an amount equal to the potential change of the common electrode. In other words, at time t5, the potential of segment electrode 52A goes to a level of −2Vss1. Thus, the potential of the collector of NPN transistor 30 is now negative with respect to the base potential of that transistor by an amount −Vss1. In this example, the collector of NPN transistor 30 will be negative by 0.78 V with respect to the base, so that current will flow from the base into the collector of NPN transistor 30. This current flow will act to discharge the capacitance between segment electrode 52A and common electrode 54 of electrochromic display cell 52, so that the potential difference between them will be gradually reduced, causing the coloration memory condition of segment electrode 52A to be terminated, i.e. bleaching of the display segment of electrochromic display cell 52 corresponding to segment electrode 52A will occur. With such a prior art display device, therefore, the time for which the coloration memory condition can be maintained is of limited duration. This problem could be overcome by providing means for periodically generating pulses of signal W1 while segment electrode 52A is in the coloration memory condition, to thereby periodically recharge the capacitance of segment electrode 52A to compensate for the current flow from the base to the collector of NPN transistor 30. However, this would result in increased power consumption, and is extremely undesirable for an electrochromic display device to be used in a miniature electronic device such as an electronic wristwatch, in which battery power consumption must be held to a very low level.

Figure 3A:
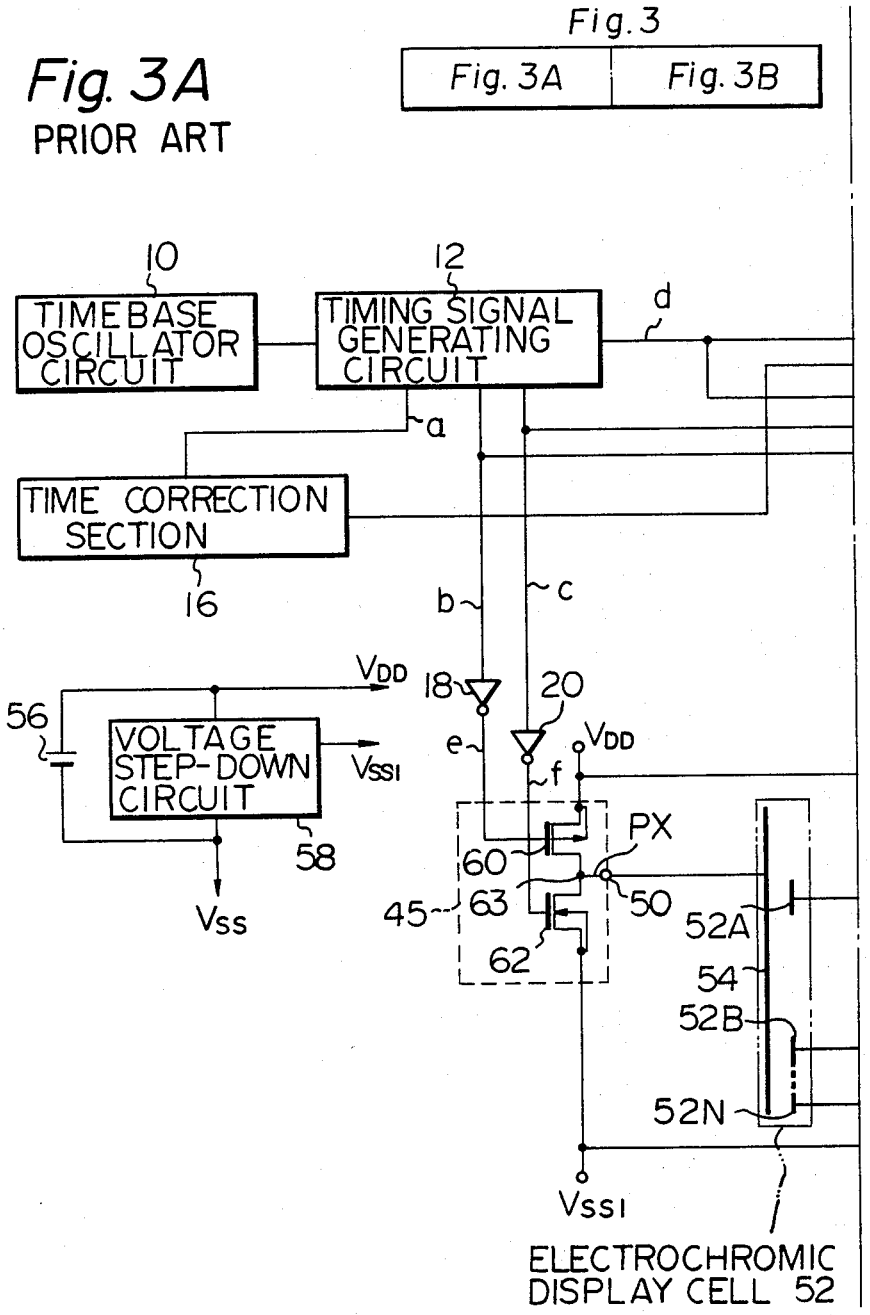
Fig. 3A PRIOR ART
FIG. 3 comprising FIGS. 3A and 3B constitute a block diagram of another embodiment of a prior art electronic timepiece including an electrochromic display cell, in which field-effect transistors are used in display drive circuits.
Figure 3B:
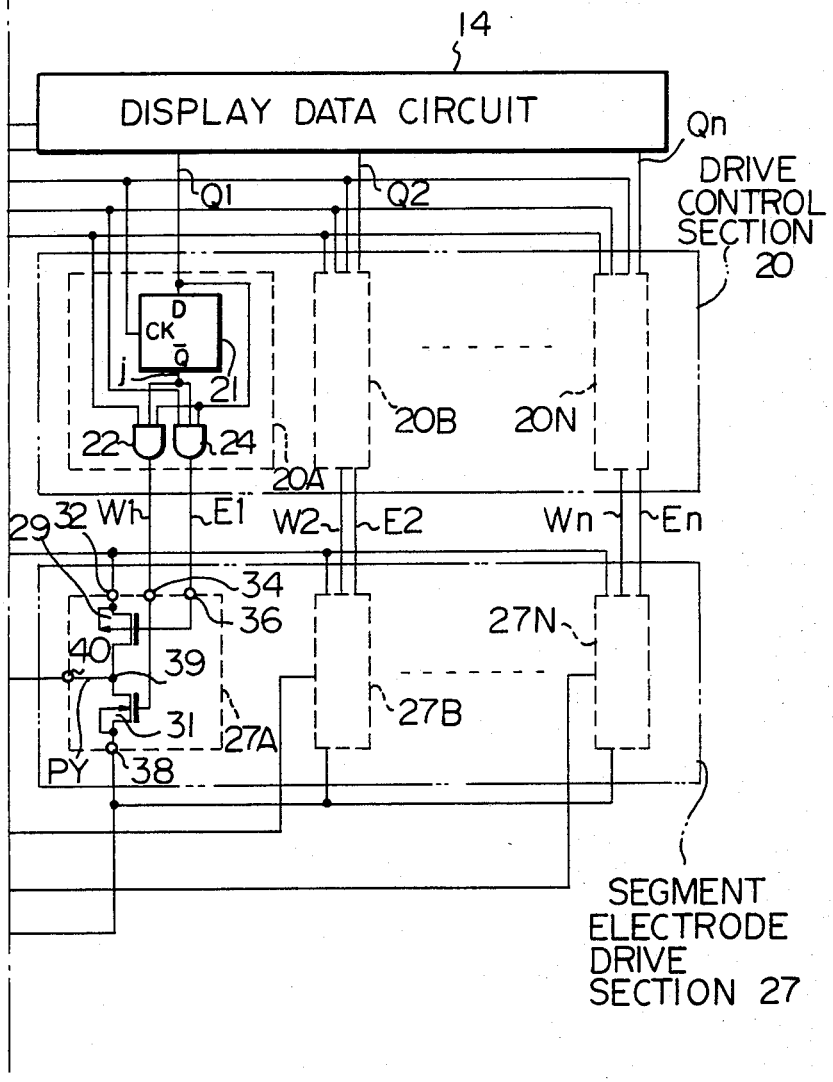
Fig. 3B PRIOR ART

Referring now to FIGS. 3A and 3B, another embodiment of an electronic timepiece incorporating an electrochromic display device is shown. This example is a prior art embodiment, which is basically identical to that of FIGS. 1A and 1B, as is indicated by the corresponding reference numerals, and which will therefore not be described in detail. The difference between this example and that of FIGS. 1A and 1B lies in the use of MOS field effect transistors (hereinafter referred to as FETs) in the segment electrode drive section, denoted by numeral 27. Each of the segment electrode drive circuits constituting the segment electrode drive section 27 has the configuration of segment electrode drive circuit 27A, comprising a pair of MOS FETs, i.e. a P-channel FET 29 and an N-channel FET 31. The drain electrodes of N-channel FET 31 and P-channel FET 29 are connected in common to terminal 40, while the source electrode of P-channel FET 29 is connected to Vdd and the source electrode of N-channel FET 31 is connected to supply potential Vss1. The gate electrodes of N-channel FET 31 and P-channel FET 29 are connected through terminals 34 and 36 to receive signals W1 and E1 respectively.

Common electrode drive circuit 45 comprises a P-channel FET 60 and an N-channel FET 62, whose drain electrodes are connected in common to common electrode 54 of electrochromic display cell 52, with the source electrode of P-channel FET being connected to Vdd and the source electrode of N-channel FET being connected to Vss1. Inverted timing signals e and f are connected to the gate electrodes of P-channel FET 60 and N-channel FET 62 respectively. The operation of this example is similar to that of FIGS. 1A and 1B. At time t4 in the timing diagram of FIGS. 2(A) to 2(I), the coloration memory condition of segment electrode 52A is established by signal W1 going to the H level and thereby causing N-channel FET 31 to go to the ON state. As a result, segment electrode 52A is set to the Vss1 potential, and at time t4 segment electrode 52A becomes, ideally, electrically isolated with both P-channel FET 29 and N-channel FET 31 in the OFF state. Subsequently, at time t9, signal E1 goes from the H level to the L level, so that P-channel FET goes to the ON state, thereby setting the potential of segment electrode 52A to Vdd. As in the example of FIGS. 1A and 1B, the potential of segment electrode 52A goes negative by an amount 2Vss1 at time t5, as a result of the transition of common electrode 54 to the Vss1 level from the Vdd level. Thus, the drain electrode of N-channel FET 31 goes negative with respect to the source electrode and substrate of that transistor by an amount Vss1, i.e. by an amount 0.78 V in this example. As a result, current flows from the substrate and source electrode to the drain electrode of N-channel FET 31, so that the capacitance between segment electrode 52A and common electrode 54 of electrochromic display cell 52 is discharged, thereby causing the potentials of segment electrode 52A and common electrode 54 to gradually become identical. Thus, as in the prior art example of FIGS. 1A and 1B, the coloration memory condition of segment electrode 52A is terminated as a result of the potential of that segment electrode being driven in the negative direction, due to the effect of transitions of common electrode drive signal PX from the Vdd level to the Vss1 level upon the capacitance of segment electrode 52A.

It can therefore be understood that with a prior art electrochromic display device such as that of FIGS. 3A and 3B, as in the example of FIGS. 1A and 1B, it is not possible to establish a coloration memory condition of the segment electrodes over a long period of time. As shown by these examples, a segment electrode drive circuit for a display segment of an electrochromic display cell according to the prior art comprises a transistor which applies a potential to the segment electrode of that display segment which is of sufficient magnitude and of such a polarity (with respect to the potential of the common electrode of the electrochromic display cell) that the segment is driven into the coloration memory condition. In the examples described above, this potential applied to the segment electrode has a value Vss1 (i.e. −0.78 V). The transistor (bipolar) or field effect type) which applies the latter potential to a segment electrode will be referred to herein as the coloration drive transistor, and is exemplified by transistors 30 and 31 in the prior art examples of FIGS. 1A and 1B and FIGS. 3A and 3B respectively. In addition, such a segment electrode drive circuit further comprises a transistor which applied a potential to the segment electrode having a magnitude and polarity such that the display segment is driven into the bleached condition. In the prior art examples described above, this potential is Vdd (i.e. OV). Such transistors are exemplified by PNP transistor 28 in the example of FIGS. 1A and 1B and P-channel FET 60 in the example of FIGS. 3A and 3B. A transistor performing the latter function will be referred to herein as a bleaching drive transistor.

Figures 4, 4A:
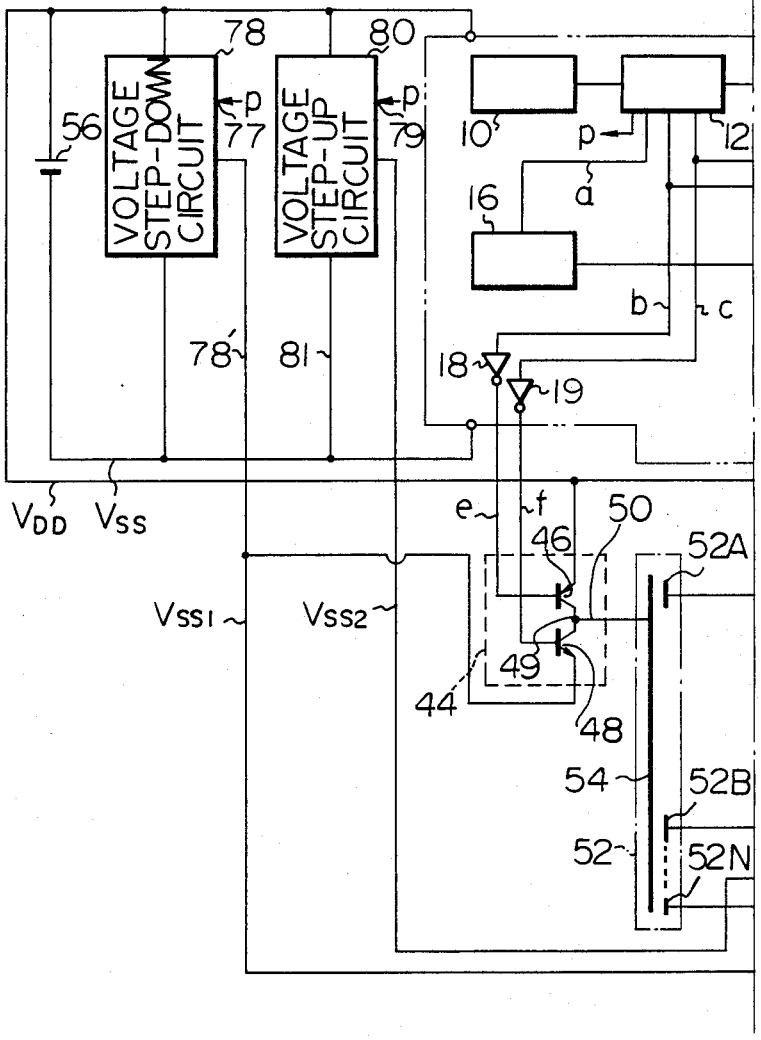
FIG. 4 comprising FIGS. 4A and 4B constitute a block diagram of a first embodiment of an electronic timepiece according to the present invention incorporating an electrochromic display cell, in which bipolar transistors are used in display drive circuits.
Figure 4B:
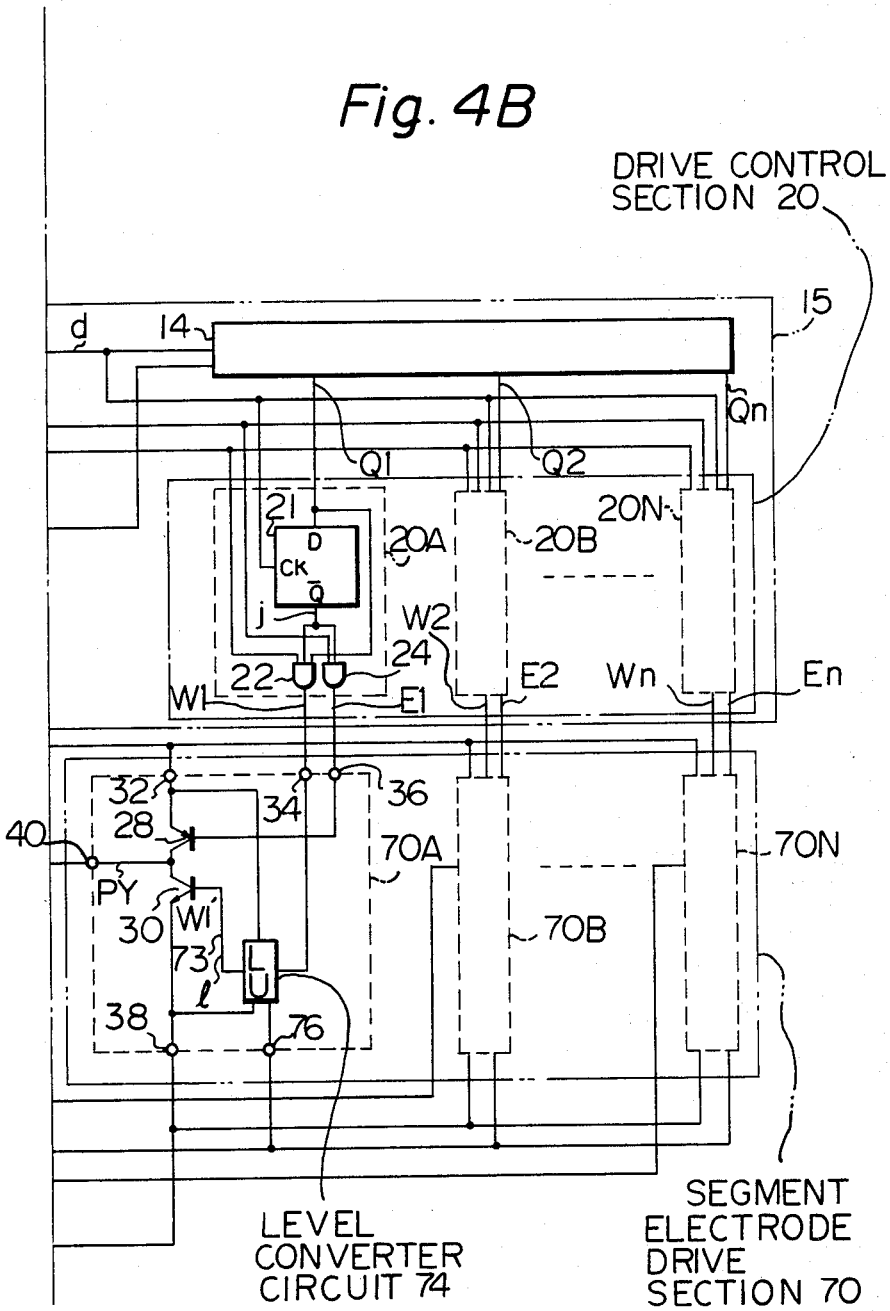

A first embodiment of a display device according to the present invention will now be described, with reference to the block diagram of FIGS. 4A and 4B. This embodiment comprises an electronic timepiece, as for the prior art examples of FIGS. 1A and 1B and FIGS. 3A and 3B described above. The essential differences between this embodiment and the prior art example of FIGS. 1A and 1B lie in the addition of a voltage step-up circuit 80, and changes in the segment electrode drive circuits which constitute the segment electrode drive section 52A. Voltage step-up circuit 80 produces a power supply voltage Vss2 which meets the following requirement:

$$V_{ss2} \leqq -\{|-V_{ss1}|+|V_{ss1}|\}$$

Each of segment electrode drive circuits 70A, 70B, . . . 70N, which receive output signals from drive control circuits 20A, 20B, . . . 20N of drive control section 20 has the configuration shown for segment electrode drive circuit 70A. This comprises a coloration drive transistor 30 and a bleaching drive transistor 28, whose collectors are coupled in common through terminal 40 to segment electrode 52A, with the emitters of transistors 28 and 30 being coupled to potentials Vdd and Vss1 respectively, and the base of bleaching drive transistor 28 being coupled through terminal 36 to receive signal E1 from drive control circuit 20A. In the latter respects, segment electrode drive circuit 70A is identical to the prior art segment electrode drive circuit 26A of FIGS. 1A and 1B. However circuit 70A further comprises a level converter circuit 74, coupled to receive coloration drive signal W1 from drive control circuit 20A and powered by the potential difference between Vdd and Vss2. In the present embodiment, Vdd=OV, Vss1=−0.78 V, and Vss2=−3.12 V. Thus, Vss2 meets the condition set by equation (1).

Figure 5:
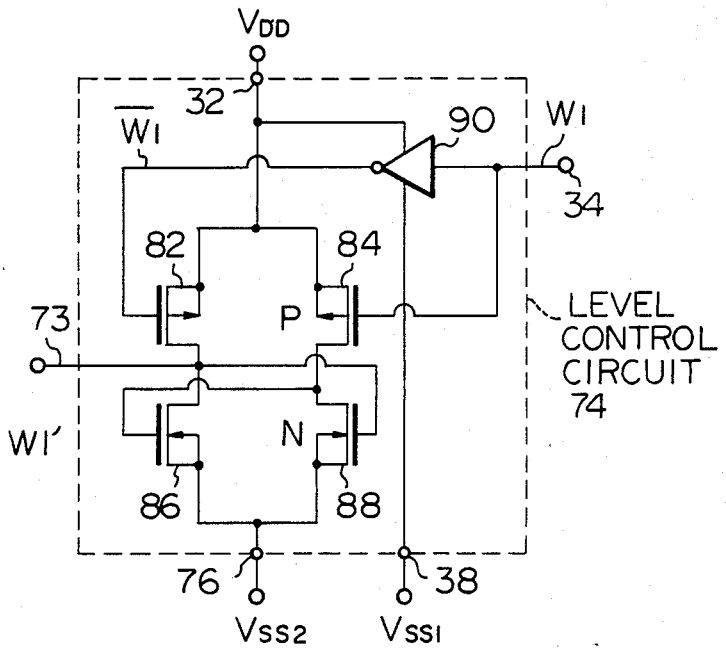
FIG. 5 is a circuit diagram of a level converter circuit used in the embodiment of FIGS. 4A and 4B.

FIG. 5 shows level converter circuit 74. This comprises an inverter 90, which is powered by the potential difference (Vdd−Vss1), two P-channel FETs 82 and 84, and two N-channel FETs 86 and 88. Coloration drive signal W1 is coupled through terminal 34 to the input of inverter 90, and also to the gate electrode of P-channel FET 84. The output of inverter 90 is coupled to the gate electrode of P-channel FET 82. The source electrodes of P-channel FETs 82 and 84 are connected in common to potential Vdd through terminal 32, while the source electrodes of N-channel FETs 86 and 88 are connected in common to potential Vss2 through terminal 76. The drain electrodes of P-channel FET 82 and N-channel FET 86 are connected in common to the gate electrode of N-channel FET 88, while the drain electrodes of P-channel FET 84 and N-channel FET 88 are connected in common to the gate electrode of N-channel FET 86. Level converter circuit 74 serves to change the logic levels of signal W1 to produce a level converted signal W1'. When signal W1 is at the Vdd level, then signal W1' is also at the Vdd level. When signal W1 goes to the Vss1 level, however, signal W1' goes to the Vss2 level.

Figure 6:
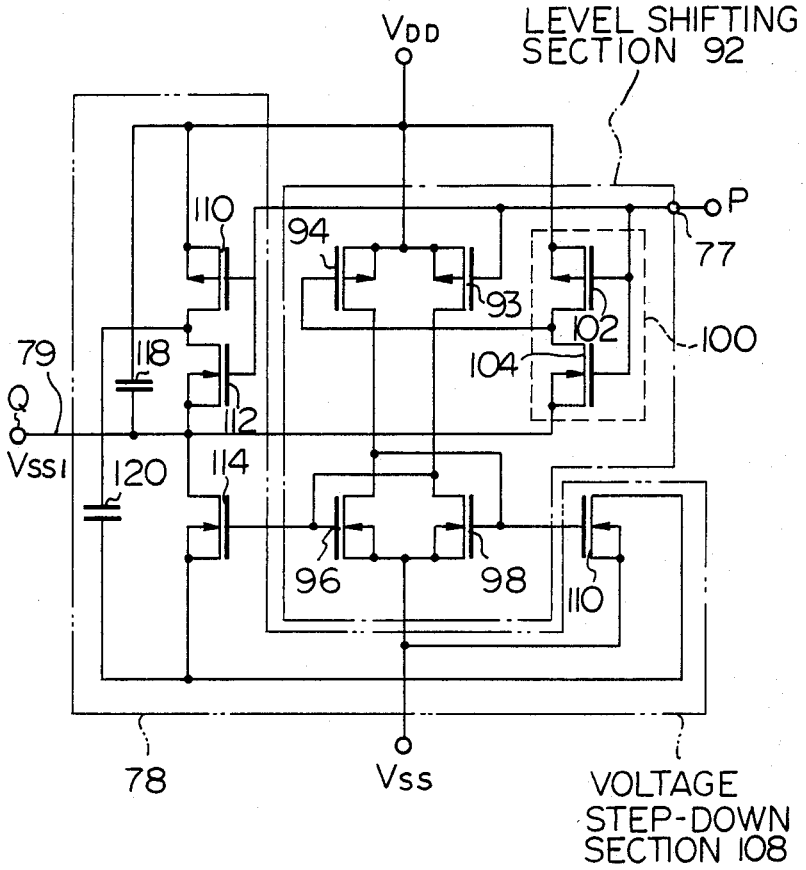
FIG. 6 is a circuit diagram of a voltage step-down circuit used in the embodiment of FIGS. 4A and 4B.

Referring now to FIG. 6, the circuit diagram is shown of voltage step-down circuit 78. This basically comprises a level shifting section 92 and a voltage step-down section 108. Level shifting section 92 comprises an inverter 100, composed of P-channel FET 102 and N-channel FET 104, P-channel FETs 93 and 94, and N-channel FETs 96 and 98. Transistors 102 and 104 of inverter 100 are connected in series between the Vdd and Vss1 potentials. Timing signal p, comprising a train of pulses with a frequency of 64 Hz in this embodiment, is applied to the input of inverter 100 and to the gate electrode of P-channel FET 93. The inverted timing signal pulses from inverter 100 are applied to the gate electrode of P-channel FET 94. The source electrodes of transistors 93 and 94 are connected in common to the Vdd potential, while the source electrodes of transistors 96 and 98 are connected in common to the Vss potential. The drain electrodes of P-channel FET 93 and of N-channel FET 98 are connected in common to the gate electrode of N-channel FET 96. The source electrodes of P-channel FET 94 and N-channel FET 96 are connected in common to the gate electrode of N-channel FET 98. Voltage step-down section 108 comprises a P-channel FET 110 and N-channel FETs 112, 114 and 116, which are connected in series between the Vdd and Vss potentials, and also comprises capacitors 118 and 120. The source electrode of P-channel FET 110 and one side of capacitor 118 are connected to the Vdd potential. The common connection of P-channel FET 110 and N-channel FET 112 is connected to one side of capacitor 120. The other side of capacitor 118 is coupled to the common connection of N-channel FETs 112 and 114, and to the source electrode of N-channel FET 104 in inverter 100. The other side of capacitor 120 is coupled to the common connection of N-channel FET 114 and N-channel FET 116. The drain electrode of N-channel FET 116 is connected to the Vss potential, while the gate electrode of N-channel FET 116 is connected to the drain electrodes of P-channel FET 94 and N-channel FET 96 in level-shifting section 92. The gate electrode of N-channel FET 114 is connected to the drain electrodes of P-channel FET 93 and N-channel FET 98.

The voltage step-down circuit of FIG. 6 acts to produce a voltage on output lead 79 of value Vss1, such that the potential difference (Vdd−Vss1) has an absolute value which is one half of that of the potential difference (Vdd−Vss), i.e. in the present embodiment in which Vss=−1.56 V, Vss1=−0.78 V.

Figure 7:
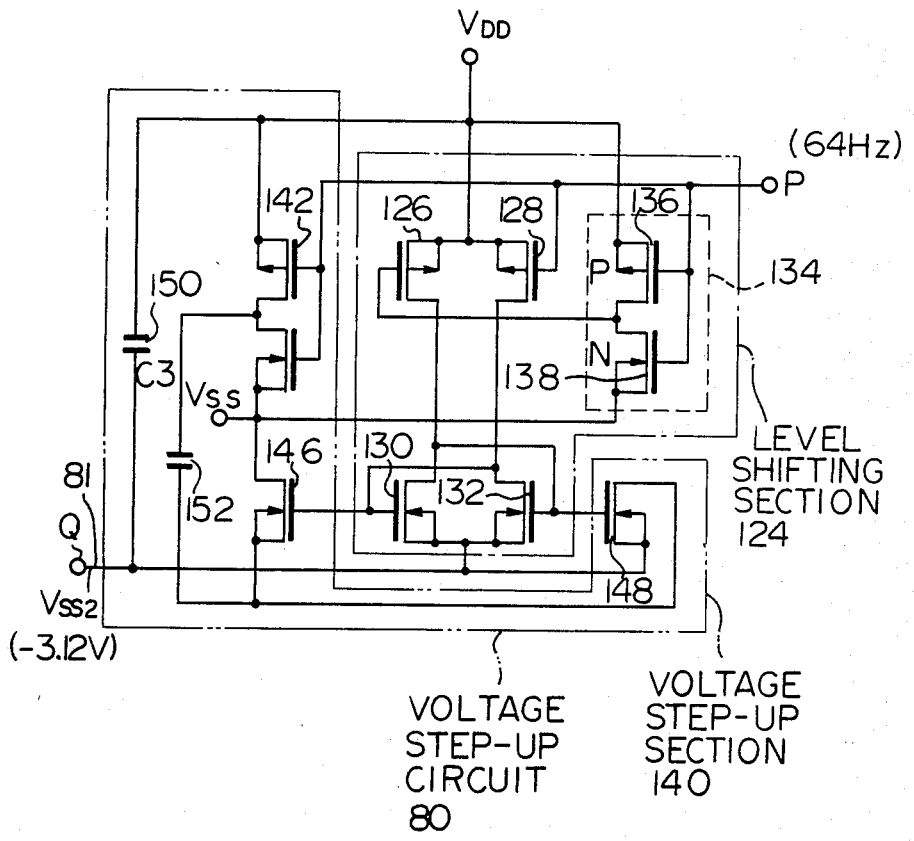
FIG. 7 is a circuit diagram of a voltage step-up circuit used in the embodiment of FIGS. 4A and 4B.

FIG. 7 is a circuit diagram of voltage step-up circuit 80. This comprises a level-shifting section 124 and a voltage step-up section 140. Level-shifting section 124 comprises an inverter 134, formed of P-channel FET 136 and N-channel FET 138, and further comprises P-channel FETs 126 and 128 and P-channel FETs 130 and 132. The source electrodes of P-channel FETs 126 and 128 are connected in common to the Vdd potential, while the drain electrodes of P-channel FET 126 and N-channel FET 130 are connected in common to the gate electrode of N-channel FET 132. The drain electrodes of P-channel FET 128 and of N-channel FET 132 are connected in common to the gate electrode of N-channel FET 130. Voltage step-up section 140 comprises a P-channel FET 136 and N-channel FETs 144, 146 and 148, all connected in series, and also capacitors 150 and 152 which have identical values. The junction of the source electrode of N-channel FET 144 and the drain electrode of N-channel FET 146 is connected to the Vss potential, which is also applied to the source electrode of N-channel FET 138 in inverter 134. Capacitor 150 is connected between the Vdd potential and the common connection of the source electrodes of N-channel FETs 130 and 132, in level-shifting section 124. Capacitor 152 is connected between the common connection of the N-channel FETs 142 and 144 and the common connection of N-channel FET 146 and N-channel FET 148. Timing pulses p, having a frequency of 64 Hz, are applied to the input of inverter 134 and to the gate electrode of P-channel FET 128. Inverted timing pulses are thereby applied to the gate electrode of P-channel FET 126.

The voltage step-up circuit of FIG. 7 acts to produce a potential Vss2 on output lead 81 having an absolute value which is twice that of the potential difference (Vdd−Vss). In the present embodiment, in which Vss=−1.56 V, Vss2=−3.12 V.

The operation of the embodiment of the present invention of FIGS. 4A and 4B will now be discussed, again with reference to the timing diagram of FIGS. 2(A) to 2(I). In this embodiment, the operation of common electrode drive circuit 44 is identical to that described for the prior art example of FIGS 1A and 1B. Thus, at time t2 in FIGS. 2(A) to 2(I), drive signal PX from common electrode drive circuit 44 goes from the floating state to the Vss1 level, and at time t3 goes from the floating state to the Vdd level. At time t3, also, segment electrode drive signal PY goes from the floating state to the Vss1 potential, due to coloration drive transistor 30 being set into the ON state by signal W1 from drive control circuit 20*a* going to the H level. Thus, as described hereinabove for the prior art examples of electrochromic display devices, segment electrode 52A is thereby set into the coloration memory condition, in which the corresponding display segment of electrochromic display cell 52 is in the colored state. In this condition, the ON state of coloration drive transistor 30 results from level converted signal W1' from level converter circuit 74 going to the Vdd potential in response to signal W1. At time t4, when signal W1 returns to the L level (i.e. the Vss1 level) then signal W1' goes to the Vss2 level as described hereinabove, i.e. to a potential of −3.12 V in this embodiment. Thus, coloration drive transistor 30 enters the OFF state, so that segment electrode 52A becomes electrically isolated, i.e. the base of coloration drive transistor 30 is now negative with respect to the emitter, which is at the Vss1 potential, while the collector remains floating at a potential of Vss1.

At time t5, drive signal PX from common electrode drive circuit 44 goes from the Vdd to the Vss1 potential. Thus, as a result of the capacitance between segment electrode 52A and common electrode 54 of electrochromic display cell 52, the potential of segment electrode 52A is driven negative by an amount equal to 2Vss1, i.e. segment electrode 52A, and hence the collector of coloration drive transistor 30 go to a potential of −1.56 V. However at this time the base of coloration drive transistor 30 is held at a potential of −3.12 V by the output from level converter circuit 74, so that coloration drive transistor 30 is held in the OFF state. Thus, no current flow occurs through coloration drive transistor 30 into segment electrode 52A, and hence the coloration memory condition of that segment electrode is held constant. This condition will be maintained until signal E1 from drive control circuit 20A goes from the H to the L level, e.g. at time t9 in FIGS. 2(A) to 2(I), when bleaching drive transistor 28 will be set into the ON state, causing drive signal PY to go to the Vdd level. Bleaching of the display segment corresponding to segment electrode 52A will then occur, and the bleached condition will be maintained until signal W1 again returns to the H level.

From the above it can be understood that the basic feature of the present invention is that the control electrode (i.e. in the above example the base) of a coloration drive transistor is held at a potential Vss2 which meets the requirement:

$$Vss2 \geqq |-Vss1| + |Vss1|$$

when a coloration memory condition of a segment electrode driven by that coloration drive transistor has been established, where potential Vss1 corresponds to the level of drive voltage required to drive the display segment corresponding to that segment electrode into the coloration condition. As a result, the coloration memory condition will be maintained over a much longer period of time than has been possible with display devices of the prior art using electrochromic display cells, since the present invention ensures complete electrical isolation of a segment electrode which is in the coloration memory condition.

In a display device according to the present invention, the coloration memory condition is established by setting a segment electrode to a potential −Vss1 with respect to the potential of the common electrode of the electrochromic display cell, and the potential −Vss1 will therefore be designated as the coloration voltage. Similarly, bleaching of a segment occurs when the segment electrode is set to a potential +Vss1 with respect to the common electrode of the electrochromic-display cell, and this potential will therefore be designated as the bleaching voltage.

Figures 8, 8A:
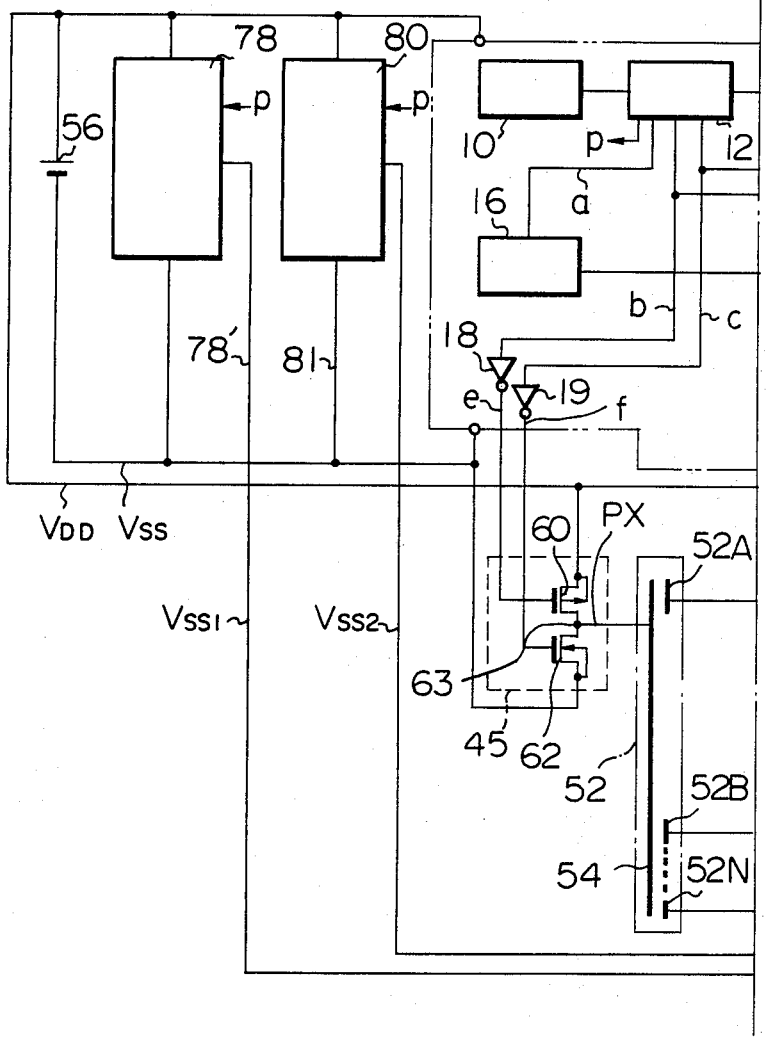
FIG. 8 comprising FIGS. 8A and 8B constitute a block diagram of a second embodiment of the present invention, in which field-effect transistors are used in display drive circuits.
Figure 8B:
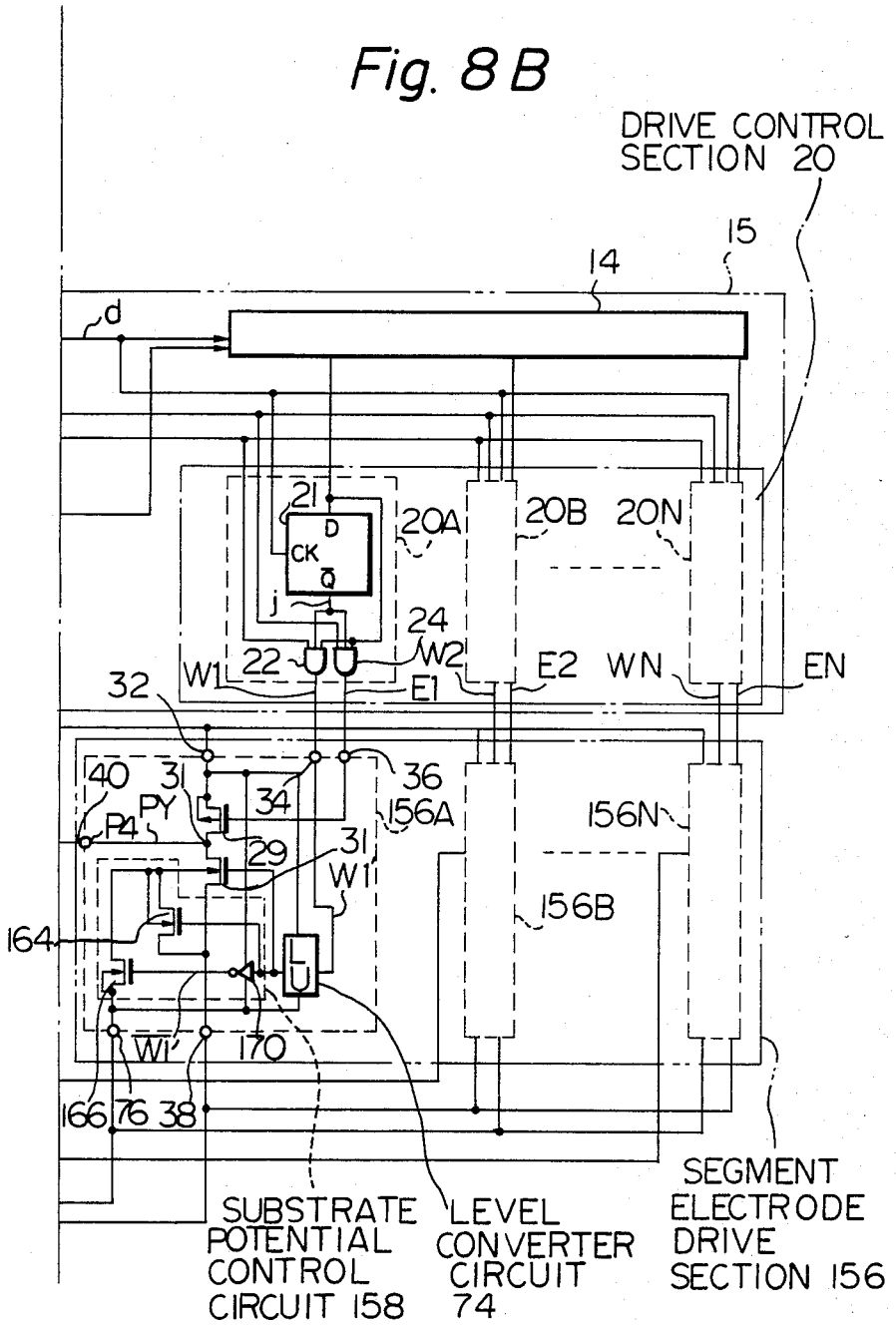

FIGS. 8A and 8B shows a second embodiment of the present invention. This is a timepiece circuit equipped with an electrochromic display cell, in which field effect transistors are used in the segment electrode drive circuits, as for the prior art example of FIG. 3. Numerals 78 and 80 denote a voltage step-down circuit for producing supply potential Vss1 and a voltage step-up circuit for producing supply potential Vss2, respectively, having the circuit configurations described hereinabove. The common electrode drive circuit 45 comprises P-channel FET 60 and N-channel FET 62, and produces drive signal PX in response to inverted timing signals e and f. Each of the segment electrode drive circuits in segment electrode drive section 156 has the circuit configuration shown for segment electrode drive circuit 156A. This comprises a bleaching drive transistor 29 and a coloration drive transistor 31, as in the prior art example of FIG. 3A, and in addition comprises a substrate potential control circuit 158A which serves to determine the voltage applied to the substrate of coloration drive transistor 31 in accordance with whether segment electrode 52A is in the coloration memory condition or in the bleaching condition. As in the prior art example of FIGS. 3A and 3B, bleaching drive transistor 29 is a P-channel FET, while coloration drive transistor 31 is an N-channel FET, with the drain electrodes of these FETs being connected in common through a terminal 40 to segment electrode 52A, and with the source electrode of bleaching drive transistor 29 being connected to the Vdd potential through terminal 32 and the source electrode of coloration drive transistor 31 being connected to the Vss1 potential through a terminal 38. Numeral 74 denotes a level converter circuit, having the configuration and functions described hereinabove for the circuit of the same reference numeral in the embodiment of FIG. 4B. Level converter circuit 74 receives signal W1 from drive control circuit 20A in drive control section 20, and produces output signal W1' at the Vdd level when signal W1 is at the H level, and at the Vss2 level when signal W1 is at the L level. As in the embodiment of FIGS. 4A and 4B, the supply potentials Vdd, Vss1 and Vss2 have the values OV, −0.78 V and −3.12 V, respectively.

Level converter circuit 74 comprises an inverter 170, an N-channel FET 164, and an N-channel FET 166. Inverter 170 is coupled to receive output signal W1' from level converter circuit 74, which is also applied to the gate electrode of coloration drive transistor 31. Inverter 170 is powered by the potential difference Vdd−Vss2. i.e. 3.12 V. The output of inverter 170 is coupled to the gate electrode of N-channel FET 166, and produces an inverted signal $\overline{W1}'$. The drain and source electrodes of N-channel FET 164 are connected between the source and substrate of coloration drive transistor 31. The source and drain electrodes of N-channel FET 166 are connected between the substrate of coloration drive transistor 31 and the Vss2 potential.

The operation of substrate potential control circuit 158A will now be described. When signal W1 goes to the H level, then signal W1' goes to the Vdd level, while output signal $\overline{W1}'$ from inverter 170 goes to the Vss2 level, i.e. to −3.12 V. N-channel FET 166 is thereby set in the non-conducting state, so that the substrate of coloration drive transistor 31 is isolated from the Vss2 potential. N-channel FET 164, on the other hand, is set into the ON condition, so that the substrate of coloration drive transistor is connected to the source electrode of that transistor.Thus, as a result of the Vdd level potential applied to the gate electrode of coloration drive transistor 31, that transistor enters the ON state, so that segment electrode 52A is driven into the coloration memory condition, i.e. the condition shown in the example of FIG. 2 at time t3 is attained. Subsequently, when signal W1 returns to the L level, e.g. at time t4 in FIG. 2, then signal W1' from level converter circuit 74 goes to the Vss2 level (i.e. −3.12 V), so that output signal $\overline{W1}'$ from inverter 170 goes to the Vdd level. As a result, N-channel FET 176 is set into the ON state, so that the substrate of coloration drive transistor 31 is connected to the Vss2 potential. At the same time, the Vss2 potential of signal W1' causes N-channel FET 164 to be set in the OFF state, thereby isolating the substrate of coloration drive transistor 31 from the source electrode of that transistor. In addition, signal W1 sets the gate electrode of coloration drive transistor 31 to the Vss2 potential. Thus, at time t5 in the example of FIGS. 2(A) to 2(I), when common electrode drive signal PX goes from the Vdd to the Vss1 level, causing segment electrode 52A to go from the Vss1 potential to the level 2Vss1, i.e. −1.56 V, then since the gate electrode of coloration drive transistor 31 and also the substrate of that transistor are held at the Vss2 potential (i.e. −3.12 V), coloration drive transistor 31 will be held in the OFF state, with no current flowing between the drain electrode and substrate, so that segment electrode 52A will be held in an electrically isolated state. Thus, the coloration memory condition of segment electrode 52A will be maintained over a much longer period of time than is possible with a prior art display device such as that shown in FIGS. 3A and 3B, as a result of applying a potential Vss2 to both the gate electrode and substrate of the coloration drive transistor 31, where Vss2 meets the requirement $$V_{ss2} \leqq -\{|-V_{ss1}|+|V_{ss1}|\}$$

while segment electrode 52A is in the coloration memory condition.

Figures 9, 9A:
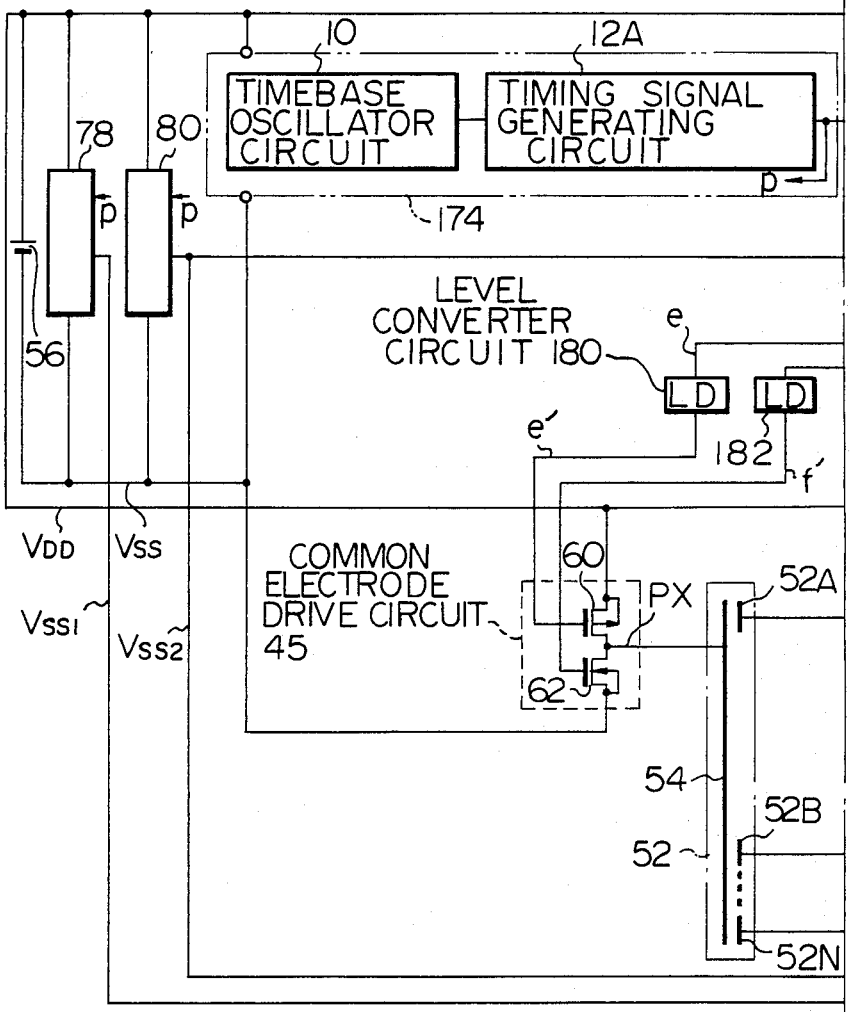
FIG. 9 comprising FIGS. 9A and 9B constitute a block diagram of a third embodiment of the present invention.
Figure 9B:
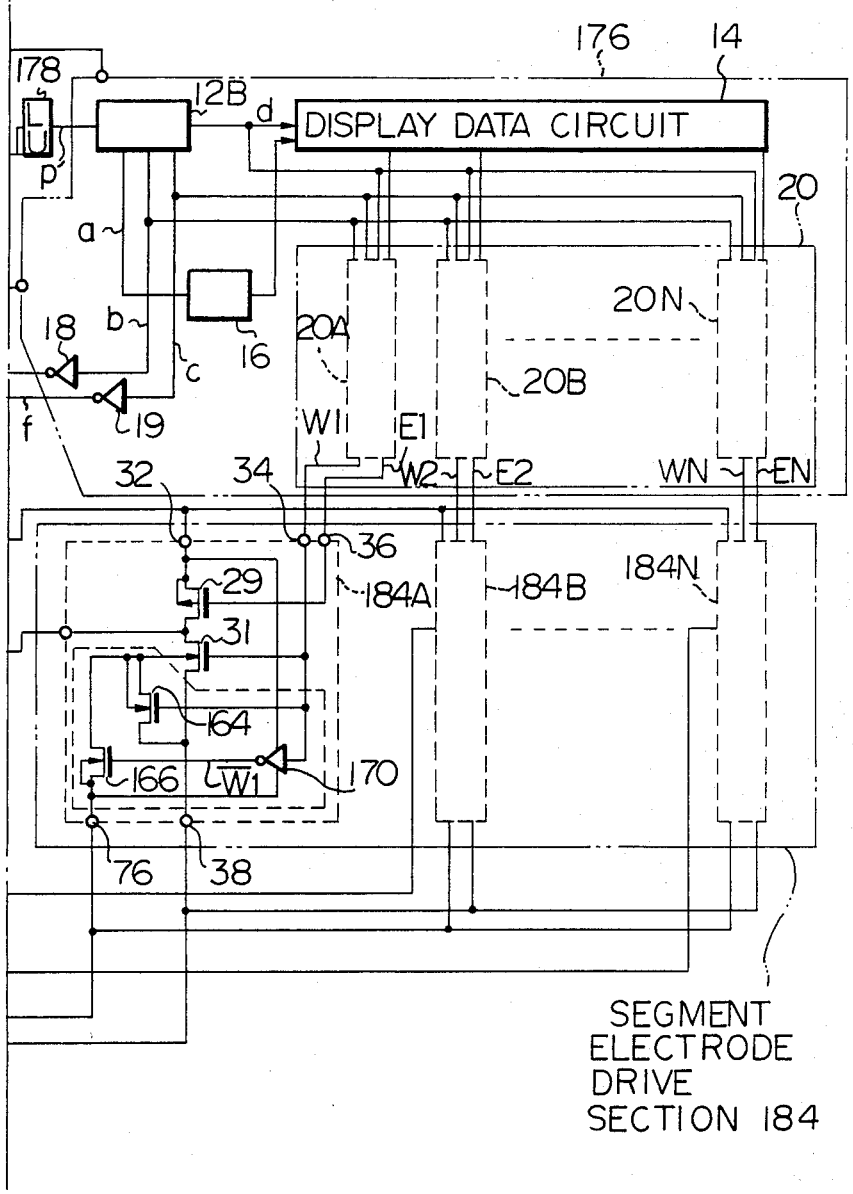

Referring now to FIGS. 9A and 9B, a third embodiment of a display device according to the present invention incorporating an electrochromic display cell will be described. In the previous embodiments of FIGS. 4A and 4B and FIGS. 8A and 8B, the timebase oscillator circuit 10, timing signal generating circuit 12, display data circuit 14 and drive control section 20 are all supplied with power at a negative potential Vss, from a battery 56, as is indicated by enclosing these sections within a broken-line rectangle 15. Since the timebase oscillator circuit and primary frequency divider stages of an electronic timepiece operate at a high frequency, it is desirable to apply a low level of supply voltage to such circuits, in order to minimize power consumption. However, later circuit stages of a timepiece operate at relatively low frequencies, so that these stages can function using a higher value of supply voltage, if necessary. In the embodiment of FIGS. 9A and 9B, a different value of supply voltage is applied to the timebase oscillator circuit 10 and to a primary timing signal generating circuit 12A (i.e. the primary frequency divider stages of the timepiece), shown enclosed within broken-line rectangle 174, than that applied to a block of circuits denoted by numeral 176. That is, circuit block 174 operates from a negative power supply potential of Vss, while circuit block 176, which contains display data circuit 14, drive control section 20, display data correction section 16, timing signal generating circuit 12B, and inverters 18 and 20, operates from a negative power supply potential of Vss2, produced from voltage step-up circuit 80. Timing pulses p, which drive voltage step-up circuit 80 and voltage step-down circuit 78, are generated by timing signal generating circuit 12A. Numeral 178 denotes a level converter circuit which receives timing pulses p and produces level-converted timing pulses p', which are input to timing signal generating circuit 12B. Level converter circuit 178 operates such that, when timing signal p is at the Vdd level, signal p' is also at the Vdd level, while when signal p is at the Vss level, signal p' goes to the Vss2 level.

All of the signals generated within circuit block 176, i.e. timing signals a, b, c, d, e and f, as well as signals W1, E1, W2, E2, . . . Wn, En from drive control section 20 perform transitions between potential levels Vdd and Vss2. As in the previous embodiments, common electrode drive circuit 45 operates from a negative supply potential of Vss1, so that level converter circuits 180 and 182 are provided for converting inverted timing signals e and f to level-converted signals e' and f' respectively for input to common electrode drive circuit 45. Level converter circuits 180 and 182 function such that when timing signal e (or f) is at the Vdd level, then output signal e' (or f') is also at the Vdd level, while when input signal e (or f) is at the Vss2 level, then output signal e' (or f') goes to the Vss1 level.

Each of the segment electrode drive circuits in segment electrode drive section 184 has the configuration shown for segment electrode drive circuit 184A. This comprises a bleaching drive transistor, i.e. P-channel FET 29, a coloration drive transistor, i.e. N-channel FET 31, and substrate potential control circuit 158A. Since signals W1 and E1 perform level transitions between the Vdd and the Vss2 potentials, in this embodiment, it is not necessary to provide a level converter circuit for signal W1 such as is used in the embodiment of FIGS. 8A and 8B. Apart from the absence of such a level converter circuit, the operation of segment electrode drive circuit 184A is similar to that of segment electrode drive circuit 156A in the embodiment of FIGS. 8A and 8B. Thus, when signal W1 goes to the Vdd level (e.g. at time t3 in the example of FIGS. 2(A) to 2(I), then inverted signal $\overline{W1}$ produced by inverter 170 in substrate potential control circuit 158A goes to the Vss2 level (i.e. to −3.12 V in this embodiment) so that N-channel FET 166 enters the OFF state, thereby isolating the substrate of coloration drive transistor 31 from the Vss2 potential, while signal W1 sets N-channel FET 164 of substrate potential control circuit 158A into the ON state, thereby connecting the substrate of coloration drive transistor 31 to the source electrode of that transistor, i.e. to the Vss1 potential. Subsequently, when signal W1 goes to the Vss2 potential, coloration drive transistor 31 and N-channel FET 164 in substrate potential control circuit 158A both go to the OFF state. Also, while output signal $\overline{W1}$ from inverter 170 goes to the Vdd level, N-channel FET 166 is set into the ON state. The substrate of coloration drive transistor 31 is thereby connected to the Vss2 potential, together with the gate electrode of that transistor, i.e. these are both held at potential of −3.12 V. As a result, no leakage of current will occur between the substrate and the drain electrode of coloration drive transistor when the coloration memory condition of segment electrode 52A has been established, as for the embodiment of FIGS. 8A and 8B described above. The coloration memory condition will thereby be retained over a long period of time.

Figure 10:
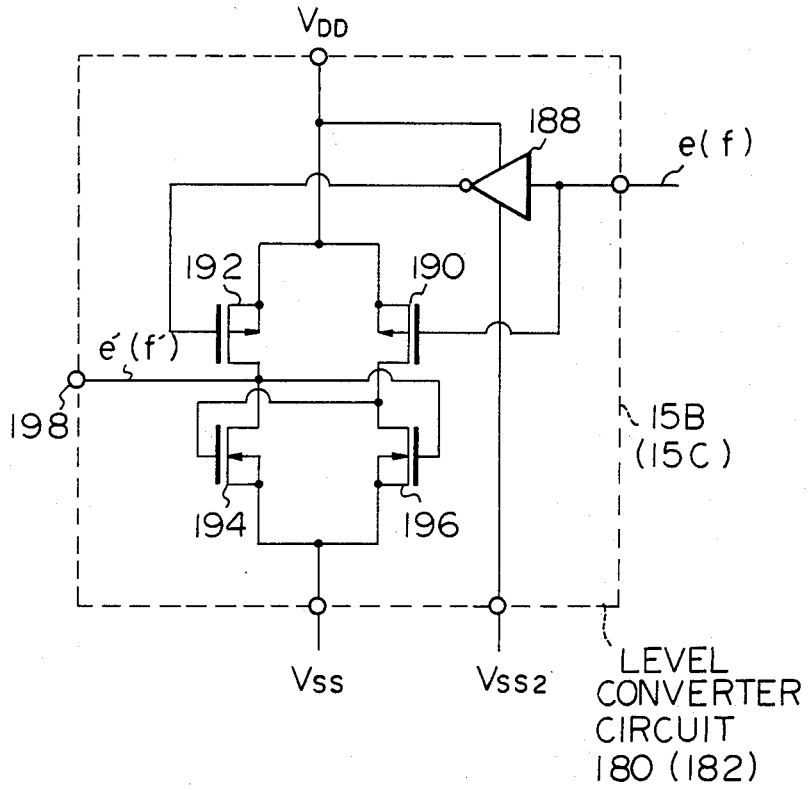
FIG. 10 is a circuit diagram of a level converter circuit used in the embodiment of FIGS. 9A and 9B.

FIG. 10 shows a suitable circuit for level converter circuits 180 and 182. This comprises an inverter 188, P-channel FETs 190 and 192, and N-channel FETs 194 and 196. Inverter 188 is powered by the potential different Vdd−Vss2. Timing signal e (or f) is applied to the input of inverter 188, and also to the gate electrode of P-channel FET 190. The output signal from inverter 180 is applied to the gate electrode of P-channel FET 192. The source electrodes of P-channel FETs 190 and 192 are connected in common to the Vdd potential, while the source electrodes of N-channel FET 194 and 196 are connected in common to the Vss potential. The drain electrodes of P-channel FET 192 and N-channel FET 194 are connected in common to the gate electrode of N-channel FET 196 and to output terminal 198. The drain electrodes of P-channel FET 190 and N-channel FET 196 are connected in common to the gate electrode of N-channel FET 194. The circuit of FIG. 10 function such that, when the input signal e (or f) goes to the Vdd level, the output on terminal 198 goes to the Vdd level, but when input signal e (or f) goes to the Vss2 level, the output signal from terminal 198 goes to the Vss level.

From the above, it can be understood that the present invention enables a coloration condition of a display element of an electrochromic display cell in a display device to be maintained over a long period of time without power being consumed to maintain the coloration condition. The present invention thereby increases the practicability of applying electrochromic display cells to miniature electronic devices such as electronic wristwatches for which a very low level of power consumption is essential.

It will be understood from the above description that the essential features of a display device according to the present invention lie in that a display segment of an electrochromic display cell is set into a coloration condition by connecting the segment electrode of that display segment to a first supply voltage (Vss1) through a coloration drive transistor while a common electrode of the electrochromic display cell is held at a second potential (Vdd) to thereby establish a first potential difference (Vdd−Vss1) between the segment electrode and common electrode, and that the display segment is set into a bleached condition by connecting the common electrode to the first supply voltage (Vss1) while connecting the segment electrode to the second supply voltage, thereby establishing a second potential difference (Vss1−Vdd) between the segment electrode and common electrode, and that after the coloration condition has been established, a third supply voltage Vss2 whose polarity is identical to that of the first supply voltage (Vss1) and whose magnitude is equal to or greater than the sum of the absolute values of the first and second potential differences between the common and segment electrodes is applied to the control electrode (base or gate) of the coloration drive transistor, whereby a coloration memory condition of the segment electrode concerned is established and maintained.

It will be further understood that with a display device according to the present invention, if the coloration drive transistor is a CMOS field effect transistor, then in addition to applying the third supply voltage (Vss2) to the gate electrode of that transistor when the coloration memory condition is established, the third supply voltage (Vss2) is also applied to the substrate of the coloration drive transistor at that time, to thereby prevent any flow of currrent from the substrate to the segment electrode concerned.

From the preceding description, it will be apparent that the objectives set forth for the present invention are effectively attained. Since various changes and modifications to the above construction may be made without departing from the spirit and scope of the present invention, it is intended that all matter contained in the above description or shown in the accompanying drawings shall be interpreted as illustrative, and not in a limiting sense. The appended claims are intended to cover all of the generic and specific features of the invention described herein.

What is claimed is:

1. A display device, comprising:

an electrochromic display cell having a common electrode and at least one segment electrode with a display segment corresponding thereto;

common electrode drive circuit means for applying periodically varying drive voltages to said common electrode;

segment electrode drive circuit means operable to apply drive voltages to said segment electrode in a predetermined timing relationship with said common electrode drive voltages for thereby selectively applying a first potential difference between said common electrode and segment electrode of appropriate polarity and amplitude to produce coloration of said display segment and a second potential difference between said common electrode and segment electrode of opposite polarity to said first potential difference and appropriate amplitude to produce bleaching of said display segment, said segment electrode drive circuit means comprising a coloration drive transistor coupled to said segment electrode, operable to be selectively set in a conducting condition to establish said first potential difference between said common electrode and segment electrode and moreover comprising circuit means operable upon establishment of said coloration condition for coupling a control electrode of said coloration drive transistor to a bias potential of suitable polarity for biasing said coloration drive transistor into a non-conductive state and whose value is a negative quantity whose absolute amplitude is equal to or less than the sum of the absolute amplitudes of said first potential difference and second potential difference applied between said common electrode and segment electrode.

2. A display device, comprising:

power supply means for producing first and second power supply potentials and a third power supply potential having the same polarity with respect to said first power supply potential as said second power supply potential, with the absolute value of the difference between said first and third power supply potentials being equal to at least twice the absolute value of the difference between said first and second power supply potentials;

display data circuit means for producing display data signals designating data to be displayed;

an electrochromic display cell having a common electrode and at least one segment electrode with a display segment corresponding thereto;

common electrode drive circuit means responsive to said timing signals for coupling said common electrode to said first power supply potential and said second power supply potential in a successively alternating manner during predetermined time intervals;

segment electrode drive circuit means comprising a bleaching drive transistor and a coloration drive transistor and control circuit means coupled to respective control electrodes of said bleaching drive transistor and coloration drive transistor, said control circuit means being responsive to said display data signals and timing signals for selectively acting to connect said sgement electrode to said first power supply potential through said bleaching drive transistor during time intervals in which said common electrode is coupled to said second power supply potential by said common electrode drive circuit means, to thereby establish bleaching of said corresponding display segment, and to connect said segment electrode to said second power supply potential through said coloration drive transistor during time intervals in which said common electrode is coupled to said first power supply potential by said common electrode drive circuit means, to thereby establish coloration of said corresponding display segment, said control circuit means further acting to connect said control electrode of said coloration drive transistor to said third power supply potential after said display segment coloration has been established, to thereby establish a coloration memory condition in which said coloration drive transistor is biased such as to be maintained in an electrically non-conductive status.

3. A display device according to claim 2, in which each of said bleaching drive transistor and said coloration drive transistor is a bipolar transistor, and in which said control electrodes constitute the base electrodes of said transistors.

4. A display device according to claim 2, in which each of said bleaching drive transistor and coloration drive transistor is a MOS field-effect transistor, and further comprising substrate potential control circuit means controlled by said display data signals for connecting the substrate of said coloration drive transistor to said third power supply potential to control the potential of said substrate, when said coloration memory condition is established.

5. A display device according to claim 2, in which said segment electrode drive circuit means comprise a drive control circuit, constituting said control circuit means thereof, coupled to receive said display data signal for selectively producing coloration drive signal and bleaching drive signal in accordance with said display data signal, and further comprising a segment electrode drive circuit including said bleaching drive transistor and said coloration drive transistor with said control electrodes thereof being controlled by said bleaching drive signal and said coloration drive signal respectively.

6. A display device according to claim 5, and further comprising a level converter circuit coupled between said control electrode of said coloration drive transistor and said drive control circuit, for receiving said coloration drive signal and producing an output signal which acts to set said coloration drive transistor control electrode to said third power supply potential when said coloration memory condition is established.

7. A display device according to claim 5, in which said coloration drive signal is applied directly to said control electrode of said coloration drive transistor, and in which said coloration drive signal goes to said third power supply potential when said coloration memory condition is established.

* * * * *